US008695582B1

(12) United States Patent
Lin

(10) Patent No.: US 8,695,582 B1
(45) Date of Patent: Apr. 15, 2014

(54) SUPPORTING ASSEMBLY FOR PORTABLE STOVE

(71) Applicant: Lieh-Tarng Lin, Chia-Yi (TW)

(72) Inventor: Lieh-Tarng Lin, Chia-Yi (TW)

(73) Assignee: Lava Outdoor Appliance Co., Ltd., Apia (WS)

( * ) Notice: Subject to any disclaimer, the term of this patent is extended or adjusted under 35 U.S.C. 154(b) by 0 days.

(21) Appl. No.: 13/684,710

(22) Filed: Nov. 26, 2012

(51) Int. Cl.
*F24C 5/00* (2006.01)

(52) U.S. Cl.
USPC ..... 126/40; 126/50; 126/30; 126/9 R; 126/9 B

(58) Field of Classification Search
USPC ..... 126/40, 50, 30, 9 R, 9 B; 248/222.52
See application file for complete search history.

(56) References Cited

U.S. PATENT DOCUMENTS

| | | | | | |
|---|---|---|---|---|---|
| 3,921,947 | A * | 11/1975 | Adam | 248/169 |
| 5,117,808 | A * | 6/1992 | Peters et al. | 126/260 |
| 5,803,727 | A * | 9/1998 | Long | 431/247 |
| 5,868,126 | A * | 2/1999 | Long et al. | 126/38 |
| 5,954,044 | A * | 9/1999 | Schmidt et al. | 126/38 |
| 5,992,407 | A | 11/1999 | Tsai | 126/40 |
| 6,182,651 | B1 * | 2/2001 | Tornsten | 126/38 |
| D446,991 | S * | 8/2001 | Taniguchi et al. | D7/337 |
| 6,742,514 | B1 | 6/2004 | Eastman, II | 126/38 |
| 7,168,426 | B1 | 1/2007 | Hsu | 126/40 |
| 7,895,999 | B2 * | 3/2011 | Graham et al. | 126/215 |
| 2008/0184981 | A1 * | 8/2008 | Su | 126/40 |

* cited by examiner

*Primary Examiner* — Alfred Basichas
(74) *Attorney, Agent, or Firm* — Alan Kamrath; Kamrath IP Lawfirm, P.A.

(57) ABSTRACT

A supporting assembly includes a base installed a portable stove and having extending portions. A plurality of connecting members is pivotally connected with the extending portions. Each of the connecting members includes a connecting wall, first and second jaw portions respectively extending from two opposite distal ends of the connecting wall. A plurality of first supporting members is pivotally connected with the first jaw portions. Each of the first supporting members includes a first supporting portion. A plurality of second supporting members is pivotally connected with the second jaw portions. Each of the second supporting members includes a second supporting portion. The supporting assembly is transformable from a folded storage position to an operative position. The first supporting portions are able to support a cooking vessel thereon. The second supporting portions support the supporting assembly on a supportive substrate.

10 Claims, 15 Drawing Sheets

SUPPORTING ASSEMBLY FOR PORTABLE STOVE

BACKGROUND OF THE INVENTION

1. Field of the Invention

The present invention relates to a supporting assembly and, more particularly, to a supporting assembly for a portable outdoor stove being foldable more compactly.

2. Description of the Related Art

A conventional portable stove is a cooking stove specially designed to be portable and lightweight, as for camping or picnicking, or for use in remote locations where an easily transportable means of cooking or heating is needed.

U.S. Pat. No. 6,742,514 discloses an outdoor cooking stove including a windscreen for shielding a burner disposed therein, and a support frame for spacing the burner and windscreen upwardly away from a supportive substrate such as the ground. The support frame includes three upstanding legs and three cross-braces. Each of the legs is attached to the windscreen using conventional fasteners, such as by welding or by using nuts and bolts. Similarly, the cross-braces are attached to the legs using conventional fasteners. Moreover, the stove includes three vessel support members attached to an inner surface of the windscreen. Although, the stove is reassembled, but assembling that is inconvenient and wasting time.

FIG. 1 of U.S. Pat. No. 7,168,426 discloses a gas stove assembly including a gas stove and a stove stand. However, the stove stand non-collapsible, and the size of that is very large and occupies much space and is inconvenient to carry during the use of the gas stove.

U.S. Pat. No. 5,992,407 discloses a miniature gas stove support including a seat, a plurality of legs, a plurality of vertical bars in the same number as that of said legs, a locating ring, and a plurality of substantially petal-shaped wind shielding members. The vertical bars have internally threaded upper and lower ends, respectively. The internally threaded lower ends of the vertical bars are engaged with the externally threaded head portions of the legs upward projected from the through holes of the seat, so that the legs are fixedly connected to the seat to support the same. Therefore, a user must assemble the seat, the legs, the vertical bars, the locating ring, and the wind shielding members to form a complete miniature gas stove support. However, assembling too many components is inconvenient, cumbersome and a waste of time for use.

The present invention is, therefore, intended to obviate or at least alleviate the problems encountered in the prior art.

SUMMARY OF THE INVENTION

The present invention solves this need and other problems in the field of a supporting assembly for a portable stove including a base, a plurality of connecting members, a plurality of first supporting members, and a plurality of second supporting members. The base is installed the portable stove and includes a plurality of extending portions extending from a central portion thereof. Each of the plurality of extending portions formed a connecting portion. Each of the plurality of connecting members is pivotally connected with each of the plurality of connecting portions of the base. Each of the plurality of connecting members includes a connecting wall, first and second jaw portions respectively extending from two opposite distal ends of the connecting wall. The plurality of first supporting members each are pivotally connected with each of the plurality of first jaw portions of the plurality of connecting members. Each of the plurality of first supporting members includes a first supporting portion extending from a distal end thereof toward the base. Each of the plurality of second supporting members is pivotally connected with each of the plurality of second jaw portions of the plurality of connecting members. Each of the plurality of second supporting members includes a second supporting portion extending from a distal end thereof.

The supporting assembly for the portable stove is transformable from a folded storage position to an operative position. The first supporting portions of the plurality of first supporting members are able to support a cooking vessel thereon. The second supporting portions of the plurality of second supporting members support the supporting assembly for the portable stove on a supportive substrate.

Preferably, the number of the plurality of connecting member is the same as that of the plurality of first and second supporting members.

Each of the plurality of first supporting members and each of the plurality of second supporting members both have arc shape.

Preferably, a bottom face of each of plurality of first supporting members facing each of plurality of second supporting members is formed a groove. A top face of each of the plurality of second supporting members is formed a bump being engagable with a groove to avoid the plurality of first supporting members and the plurality of second supporting members inadvertently pivoted with each other.

An advantage of the supporting assembly for the portable stove according to the present invention is that the supporting assembly is reversibly transformable between a folded storage position and an operative position. When the supporting assembly is disposed in the folded storage position, the plurality of second supporting members and the base are substantially horizontally aligned, and the plurality of second supporting members and the plurality of first supporting members are parallel to each other, so that the supporting assembly is formed in a disc-shape for easy storage or transportation.

Another advantage of the supporting assembly for the portable stove according to the present invention is that the supporting assembly is transformable from the folded storage position to the operative position without any tools for assembling, and avoids the components thereof lost.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
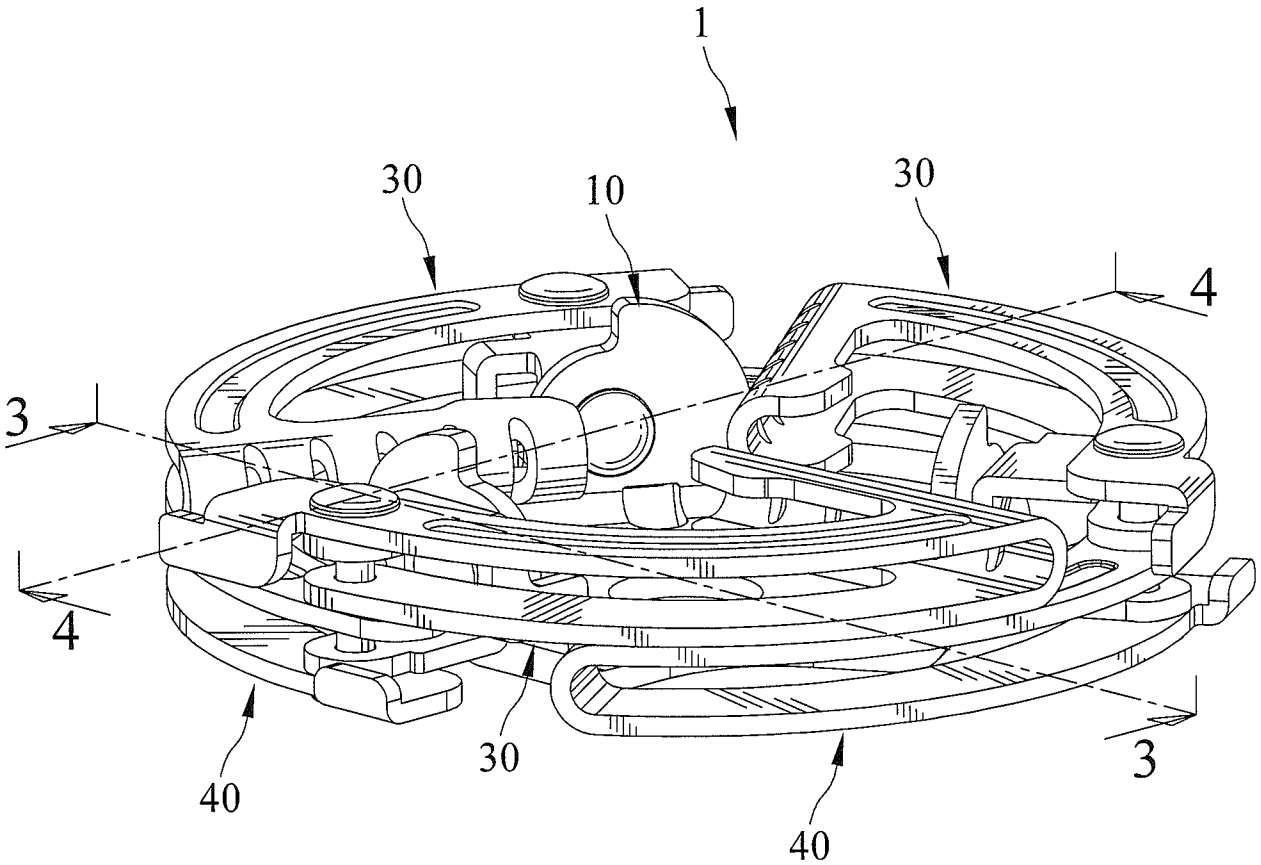
FIG. 1 shows a perspective view of a supporting assembly for a stove according to the present invention, and illustrates the supporting assembly being in a folded storage position.
Figure 2:
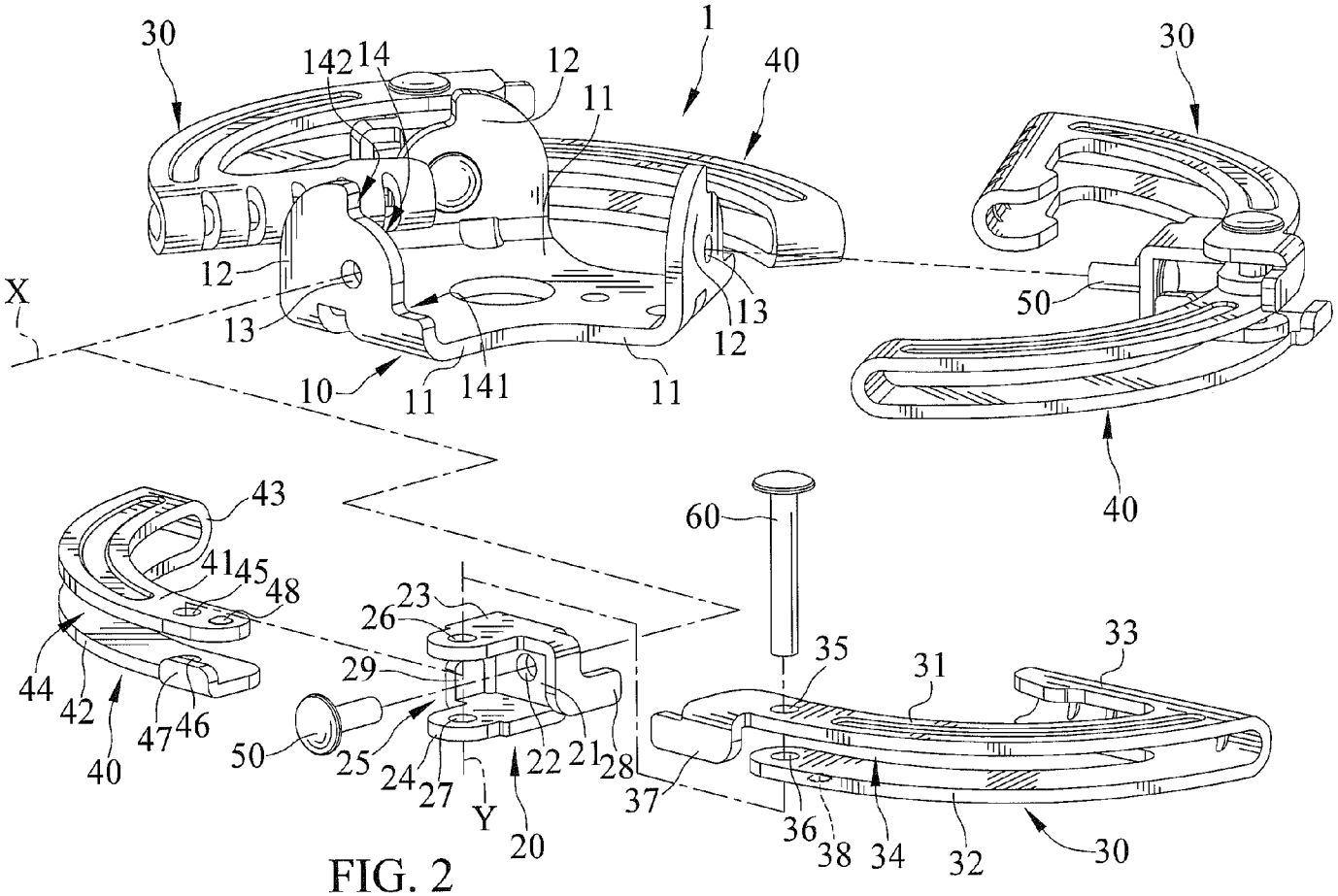
FIG. 2 shows an exploded, perspective view of the supporting assembly for the portable stove of FIG. 1.
Figure 3:
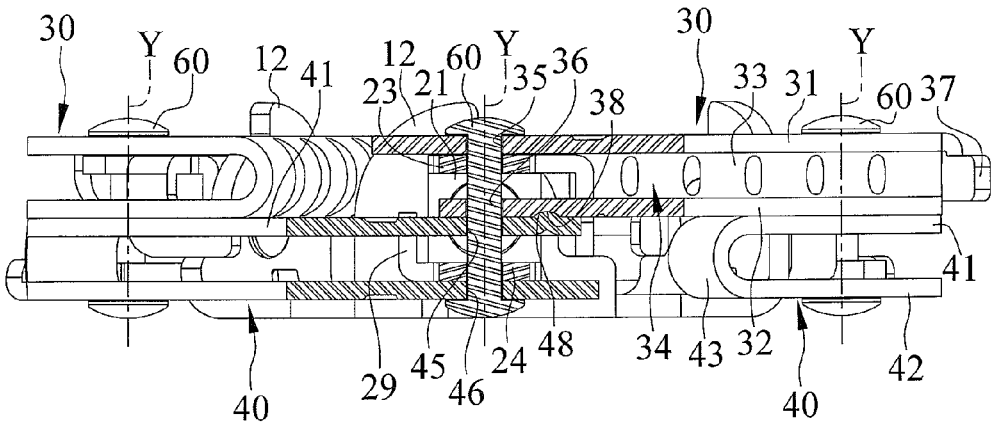
FIG. 3 shows a cross-section view taken along line 3-3 of FIG. 1.
Figure 4:
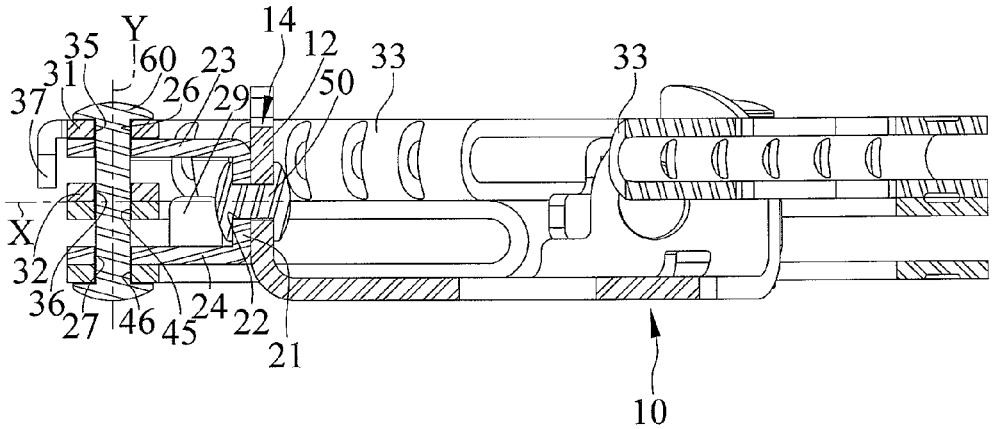
FIG. 4 shows a cross-section view taken along line 4-4 of FIG. 1.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "end", "portion", "longitudinal", "radial", "diameter", "width", "thickness", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE PREFERRED EMBODIMENTS

FIGS. 1 through 4 show a supporting assembly 1 for a portable stove 2 according to the present invention shown in the drawings. The supporting assembly 1 includes a base 10, a plurality of connecting members 20, a plurality of first and second supporting members 30 and 40. In a preferred form, the number of the plurality of connecting member 20 is the same as that of the plurality of first and second supporting members 30 and 40. An end of each of the plurality of connecting members 20 is pivotally connected with the base 10, and another end of each of the plurality of connecting members 20 is pivotally connected with one of the plurality of first supporting members 30 and one of the plurality of second supporting members 40. In this embodiment, the supporting assembly 1 includes three connecting members 20, three first and three second supporting members 30 and 40, which are correspond to each other.

The base 10 is substantially formed a Y-shaped cross section and includes three extending portions 11 extending outward from a central portion thereof and formed between three angles of the same angle. Three connecting portions 12 each are vertically extended from distal ends of each of the three extending portions 11. Each of the three connecting portions 12 includes a first through hole 13 extending along a first axis X, and an arc-shaped recess 14 formed at a side edge thereof. The recess 14 has first and second positioning ends 141 and 142, with the first positioning end 141 disposed adjacent to the extending portion 11 and the second positioning end 142 disposed opposite to the first positioning end 141.

The three connecting members 20 are pivotally connected with the connecting portions 12, respectively. Each of the three connecting members 20 includes a connecting wall 21 abutted against each of the three connecting portions 12 of the base 10, a second through hole 22 extending at the connecting wall 21 along the first axis X and aligned with the first through hole 13 of each of the three connecting portions 12, first and second jaw portions 23 and 24 respectively extending horizontally outwardly from two opposite distal ends of the connecting wall 21 and cooperating to form a gap 25 adapted for receiving the first and second supporting member 30 and 40. The first and second jaw portions 23 and 24 of each of the three of connecting members 20 are respectively axially formed first and second apertures 26 and 27 extending along a second axis Y perpendicular to the first axis X. Moreover, each of the three connecting members 20 further includes a first resisting portion 28 extending from a side edge of the first jaw portion 23 in a direction parallel to the first axis X. Each of the first resisting portions 28 is adapted for extending into each of the recesses 14 of the base 10 and selectively abutting against the first and second positioning ends 141 and 142. Additionally, each of the three connecting members 20 further includes a second resisting portion 29 extending vertically from a side edge of the second jaw portion 24 in a direction parallel to the second axis Y. Each of the three second resisting portions 29 is adapted for abutting against each of the three first supporting members 30.

Each of the three first supporting members 30 has an arc shape and is pivotally connected with each of the first jaw portions 23 of the three connecting members 20. Each of the three first supporting members 30 includes first and second body portions 31 and 32 connected with each other therein, a first supporting portion 33 extending axially inward from distal ends of the first and second body portions 31 and 32 toward the base 10, a first slot 34 formed between the first and second body portions 31 and 32 and adapted for receiving the first jaw portion 23 of the connecting member 20. The first and second body portions 31 and 32 of each of the three first supporting members 30 are respectively axially formed third and fourth apertures 35 and 36 extending along the second axis Y at terminal ends thereof opposite to the first supporting portion 33. Each of the first body portions 31 includes a first abutting section 37 extending from a side edge of the terminal end thereof and selectively abutting against each of the three connecting portions 12 of the base 10 to provide a positioning function between the three first supporting members 30 and the base 10. A bottom face of each of the second body portions 32 facing each of the three second supporting members 40 is formed a groove 38 being engagable with the second supporting member 40.

Each of the three second supporting members 40 has an arc shape and is pivotally connected with each of the second jaw portions 24 of the three connecting members 20. Each of the three second supporting members 40 includes third and fourth body portions 41 and 42 connected with each other therein, a second supporting portion 43 formed between distal ends of the third and fourth body portions 41 and 42, a second slot 44 formed between the third and fourth body portions 41 and 42 and adapted for receiving the second jaw portions 24 of the connecting member 20. The third and fourth body portions 41 and 42 of each of the three second supporting member 40 are respectively axially formed fifth and sixth apertures 45 and 46 extending along the second axis Y at terminal ends thereof opposite to the second supporting portion 43. Each of the fourth body portions 42 includes a second abutting section 47 extending from a side edge of a terminal end thereof toward the third body portion 41 and selectively abutting against the second jaw portion 24 of each of the three connecting members 20 to provide positioning function between the second supporting member 40 and the connecting members 20. A top face of each of the third body portions 41 is formed a bump 48 being engagable with the groove 38 of each of the second body portions 32

A plurality of first fasteners 50 respectively pass through each of the second through holes 22 of the connecting members 20 and each of the first through holes 13 of the connecting portions 12. Then each of the plurality of connecting members 20 are pivotally connected with each of the plurality of connecting portions 12 along the first axis X by riveting.

A plurality of second fasteners 60 respectively pass through each of third apertures 35 of the first supporting members 30, each of the first apertures 26 of the connecting members 20, each of the fourth apertures 36 of the first supporting members 30, each of the fifth apertures 45 of the second supporting members 40, each of the second apertures 27 of the connecting members 20, and each of the sixth apertures 46 of the second supporting members 40. Then each of the plurality of first and second supporting members 30 and 40 are both pivotally connected with each of the plurality of connecting member 20 along the second axis Y by riveting.

The supporting assembly 1 for the portable stove 2 is reversibly transformable between a folded storage position and an operative position. When the supporting assembly 1 is disposed in the folded storage position, the three second supporting members 40 and the base 10 are substantially horizontally aligned, and the three second supporting members 40 and the three first supporting members 30 are parallel to each other, so that the supporting assembly 1 is formed in a disc-shape for easy storage or transportation. Each of the first resisting portions 28 of the three connecting members 20 is abutted against the first positioning end 141 of each of the recesses 14, with each of the second body portions 32 of the three first supporting members 30 abutted against each of the third body portions 41 of the three second supporting members 40, with each of the first supporting portions 33 of the three first supporting members 30 engaged with a space formed between two of the three connecting portions 12, with each of the bumps 48 of each of the three second supporting members 40 engaging into each of the grooves 38 of each of the three first supporting members 30 to provide a positioning function between the first and second supporting members 30 and 40.

Figure 5:
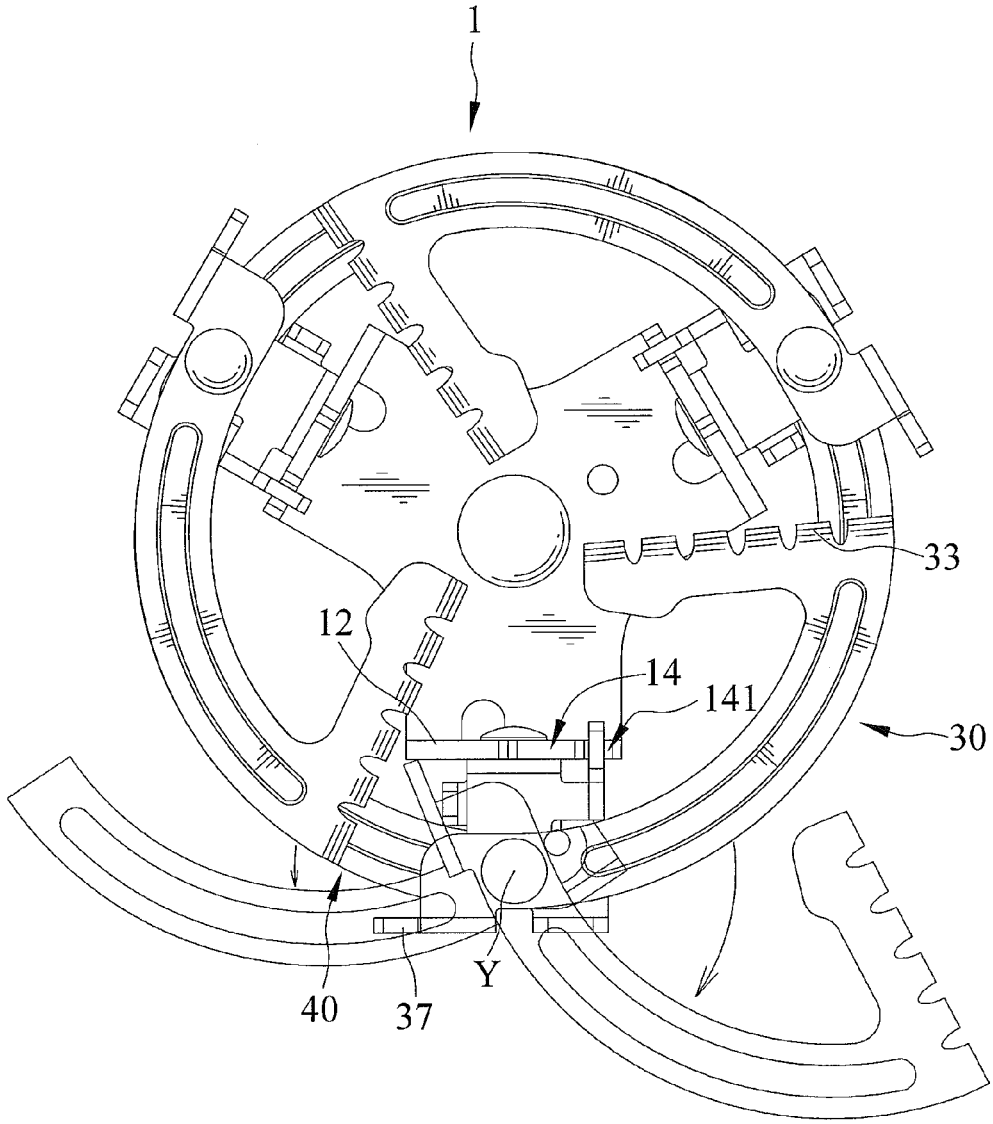
FIG. 5 shows a top view of the supporting assembly for the portable stove of FIG. 1, and illustrates first and second supporting members pivoted relative to a connecting member.
Figure 6:
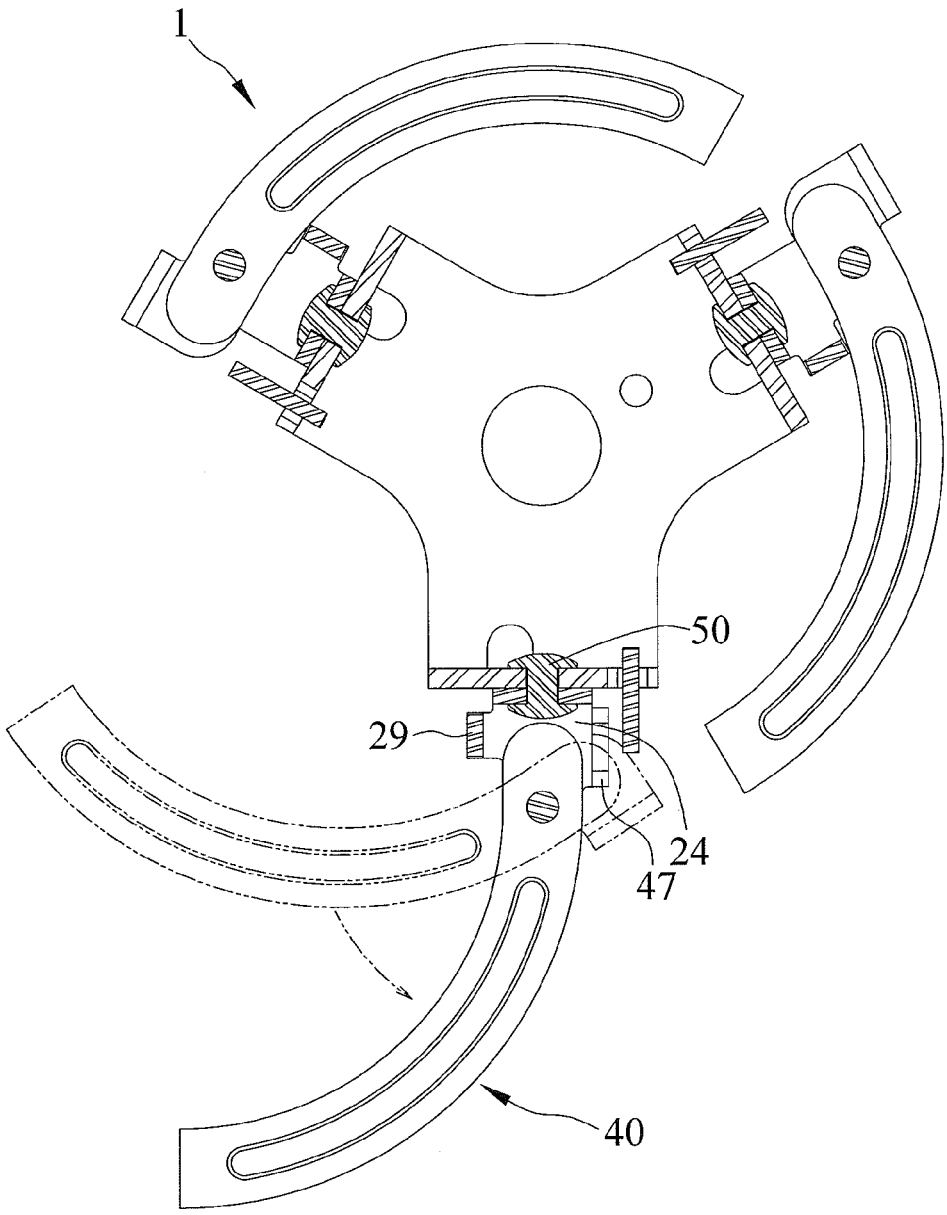
FIG. 6 shows a cross-section view of the supporting assembly for the portable stove of FIG. 5, and illustrates the second supporting member further pivoted relative to the connecting member.
Figure 7:
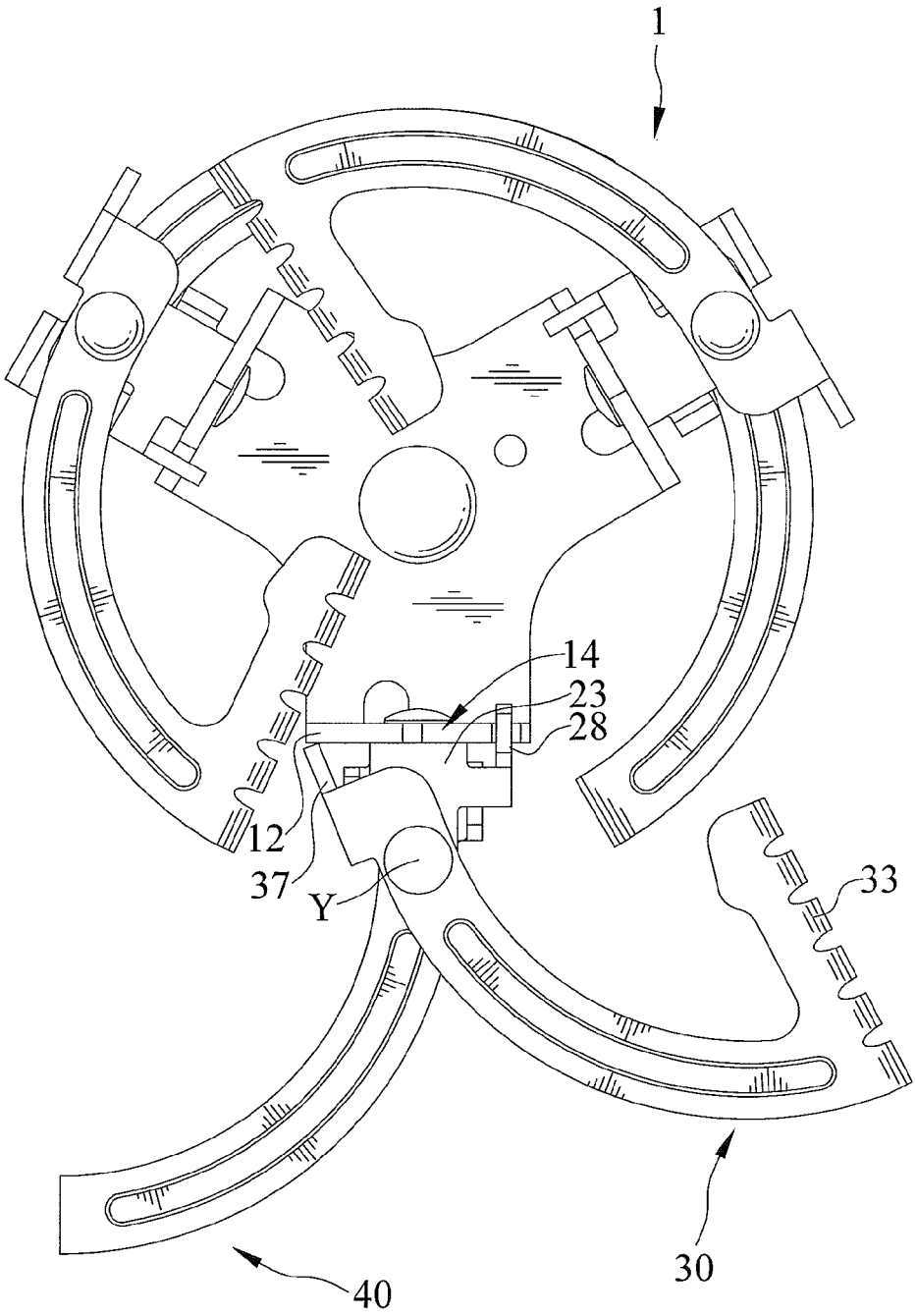
FIG. 7 shows a continued view of the supporting assembly for the portable stove of FIG. 5, and illustrates a first abutting section of the first supporting member abutted against a connecting portion of a base.
Figure 8:
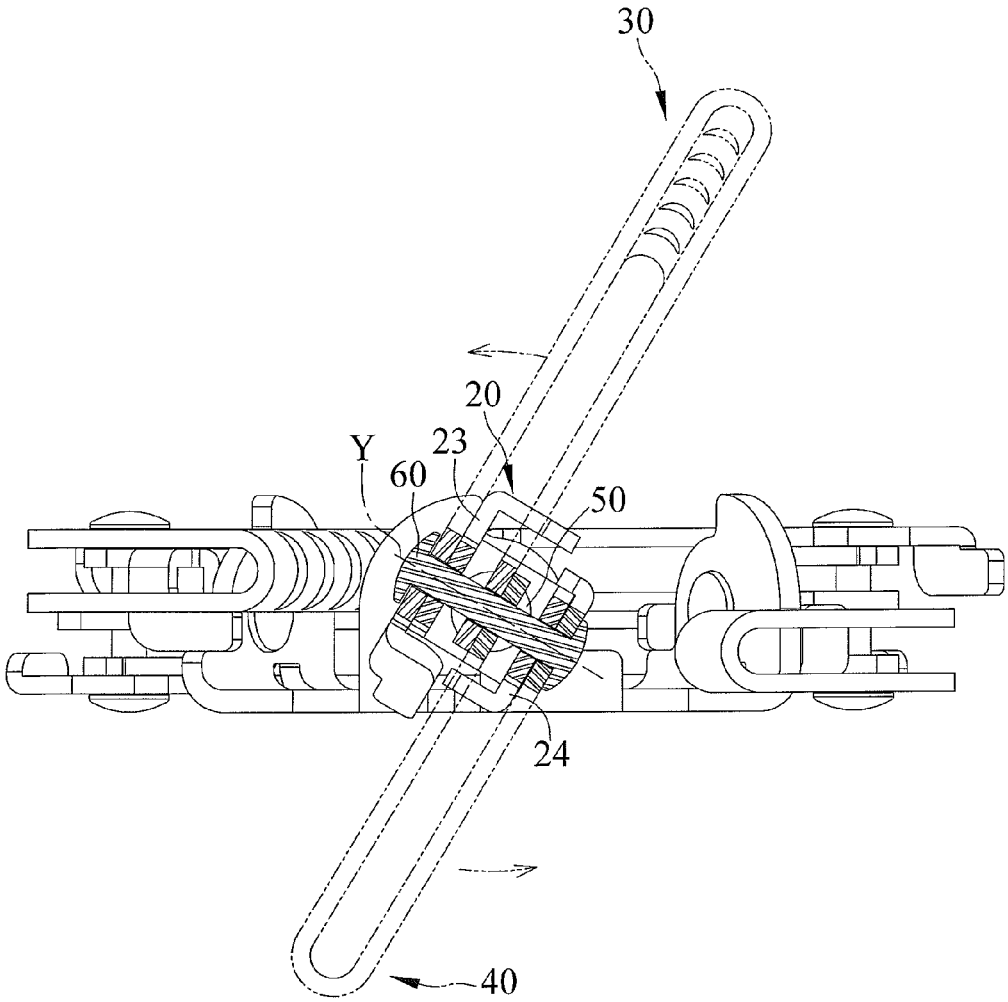
FIG. 8 shows a side cross-section view of the supporting assembly for the portable stove, and illustrates the connecting member pivoted relative to the base.
Figure 9:
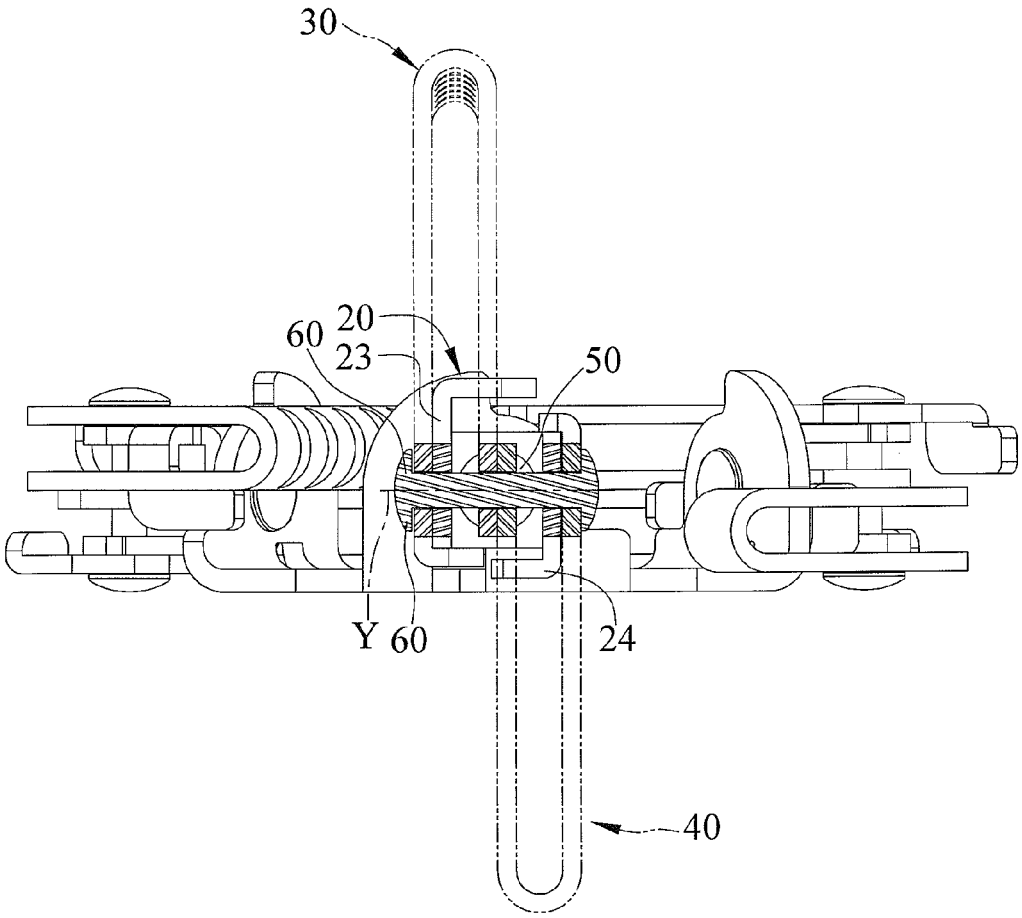
FIG. 9 shows a continued view of the supporting assembly for the portable stove of FIG. 8, and illustrates the connecting member pivoted counterclockwise through 90 degrees with respect to the base.
Figure 10:
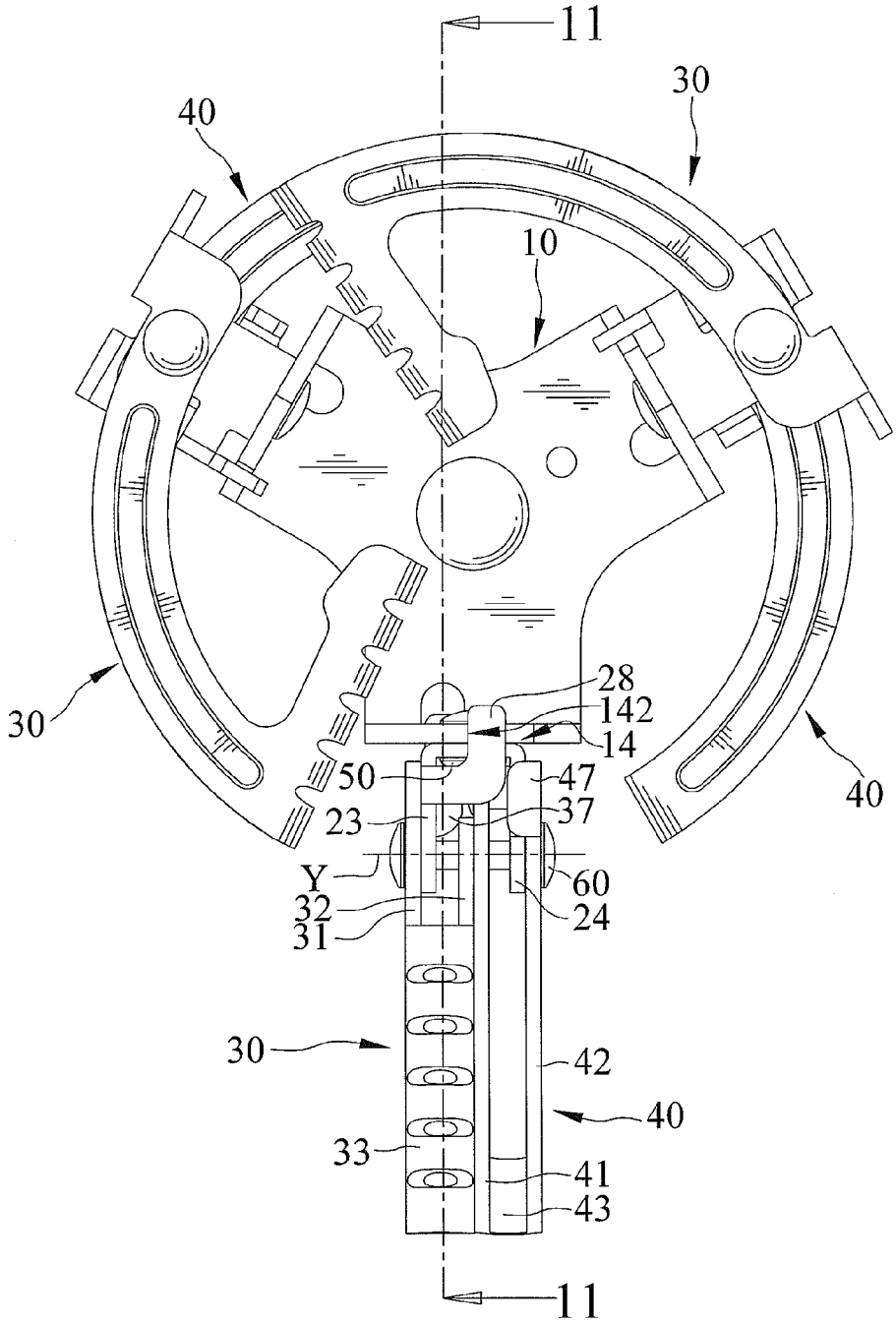
FIG. 10 shows a top view of the supporting assembly for the portable stove of FIG. 9.
Figure 11:
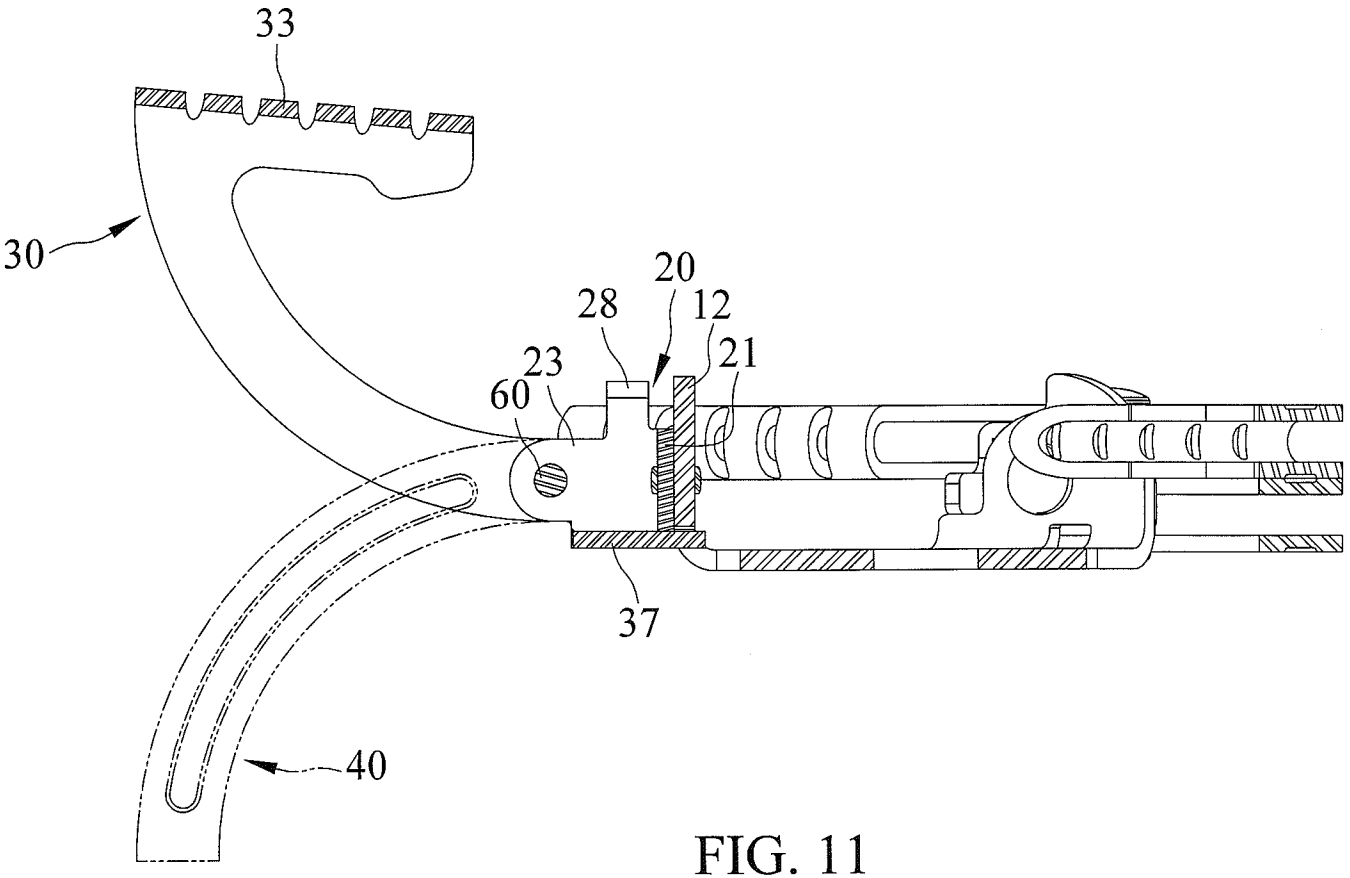
FIG. 11 shows a cross-section view taken along line 11-11 of FIG. 10.
Figure 12:
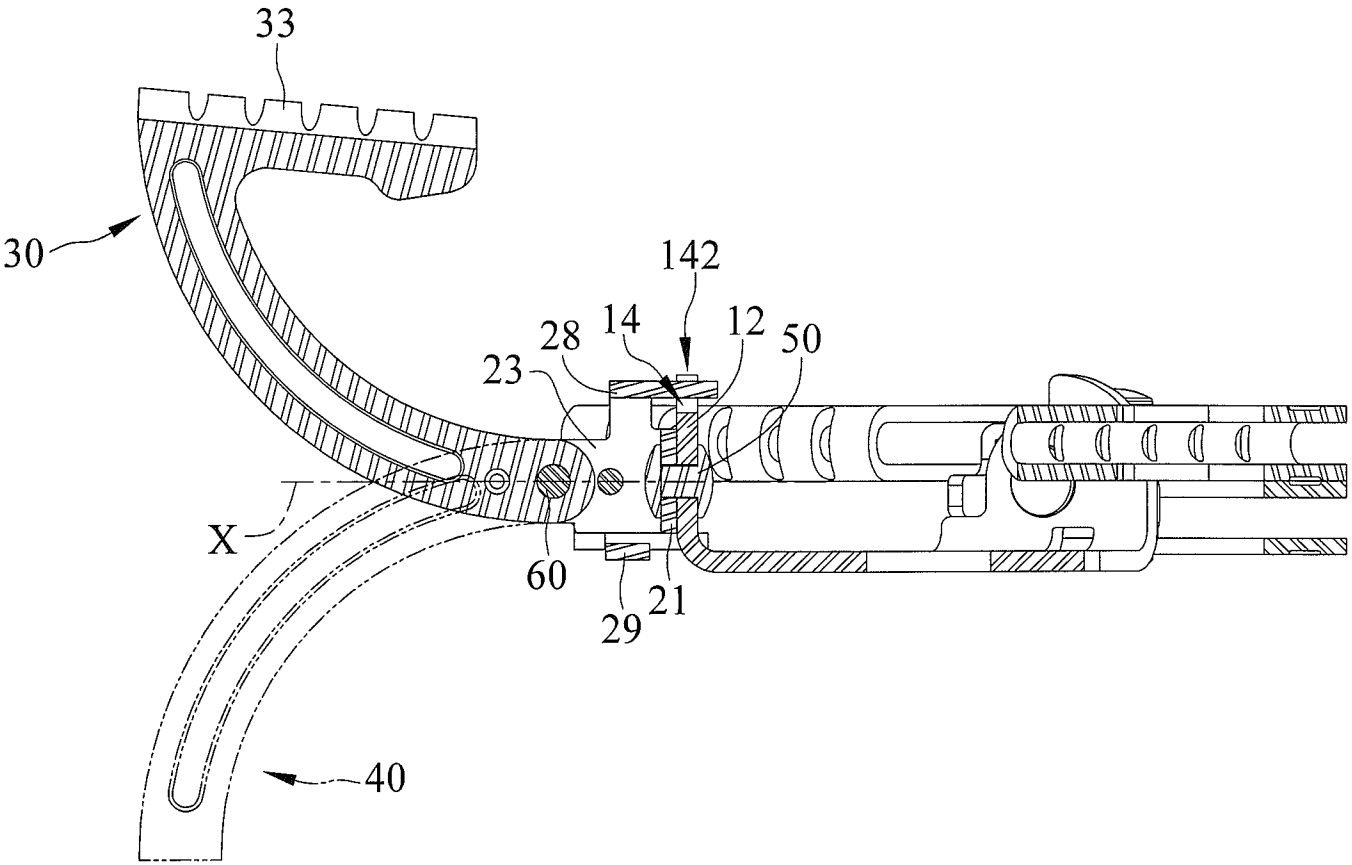
FIG. 12 shows another cross-section view of the supporting assembly for the portable stove of FIG. 10.
Figure 13:
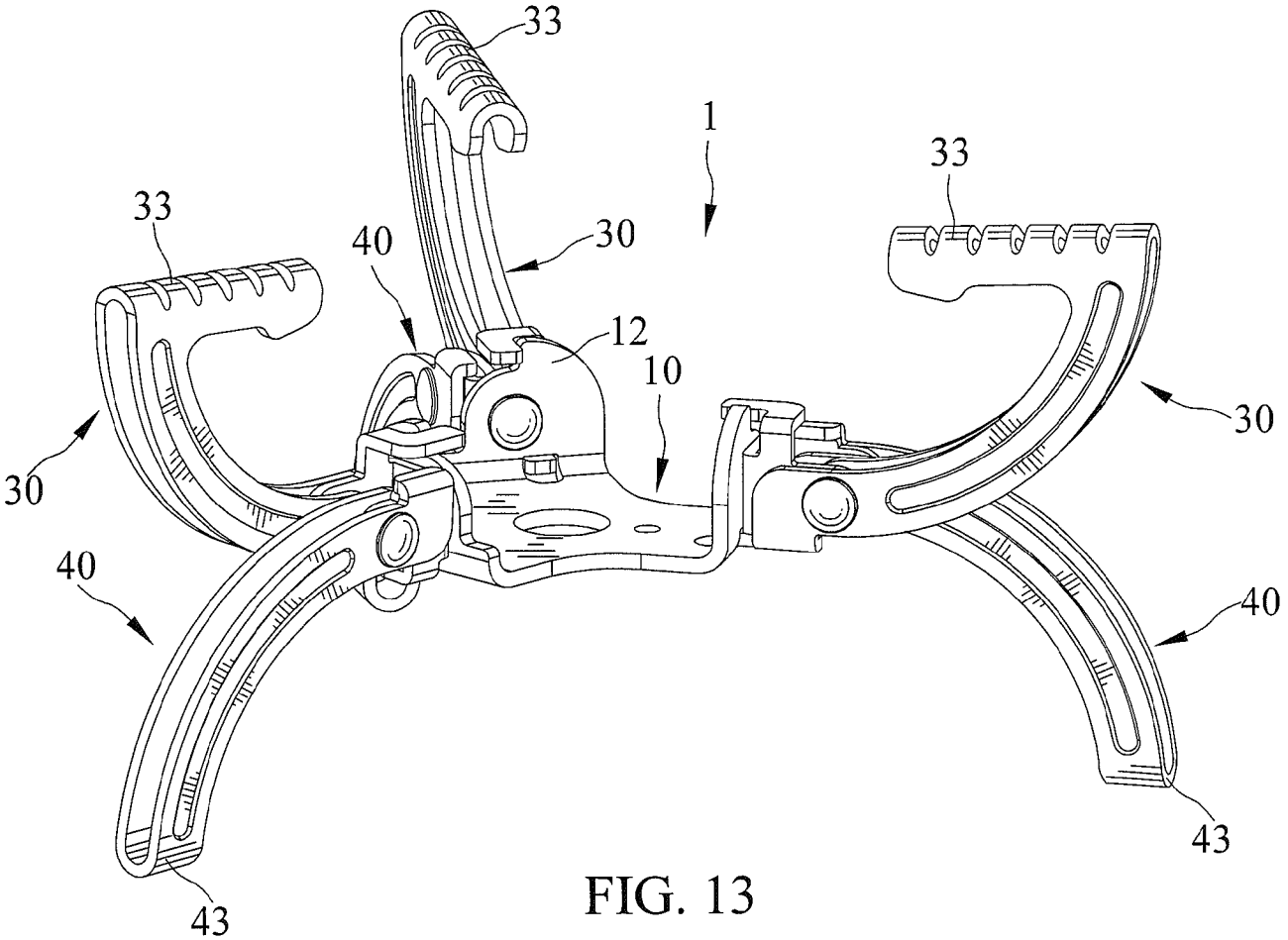
FIG. 13 shows a perspective view of the supporting assembly for the stove according to the present invention, and illustrates the supporting assembly being in an operative position.

FIGS. 5 through 7 show one of the three first supporting members 30 pivoted clockwise through a first angle with respect to one of the of the three connecting members 20 along the second axis Y, and one of the three second supporting members 40 is pivoted counterclockwise through a second angle with respect to one of the of the three connecting members 20 along the second axis Y, with one of the first supporting portions 33 of the three first supporting members 30 disengaged from the space formed between two of the three connecting portions 12, with one of the second abutting sections 47 of the three second supporting members 40 abutted against one of the second jaw portions 24 of the three connecting members 20, with one of the bumps 48 of one of the three second supporting members 40 disengaging from one of the grooves 38 of one of the three first supporting members 30. Moreover, the first angle is greater than the second angle.

FIGS. 8 through 13 show one of the three connecting members 20 pivoted counterclockwise through 90 degrees with respect to the base 10 along the first axis X to cause the second axis Y rotated through 90 degrees with respect to the first axis X, with one of the first resisting portions 28 of the three connecting members 20 abutted against one of the second positioning ends 142 of the recesses 14, with one of the first abutting sections 37 of one of the three first supporting members 30 abutted against one of the three connecting portions 12 of the base 10 and one of the connecting walls 21 of the three connecting members 20. Therefore, the supporting assembly 1 for the portable stove 2 is transformable from the folded storage position to the operative position. Additionally, the first supporting portions 33 of the three first supporting members 30 are able to support a cooking vessel thereon, such as a pot or pan, and the second supporting portions 43 of the three second supporting members 40 are able to support the supporting assembly 1 for the portable stove 2 on a supportive substrate such as the ground to cause a convection space formed between.

Figure 14:
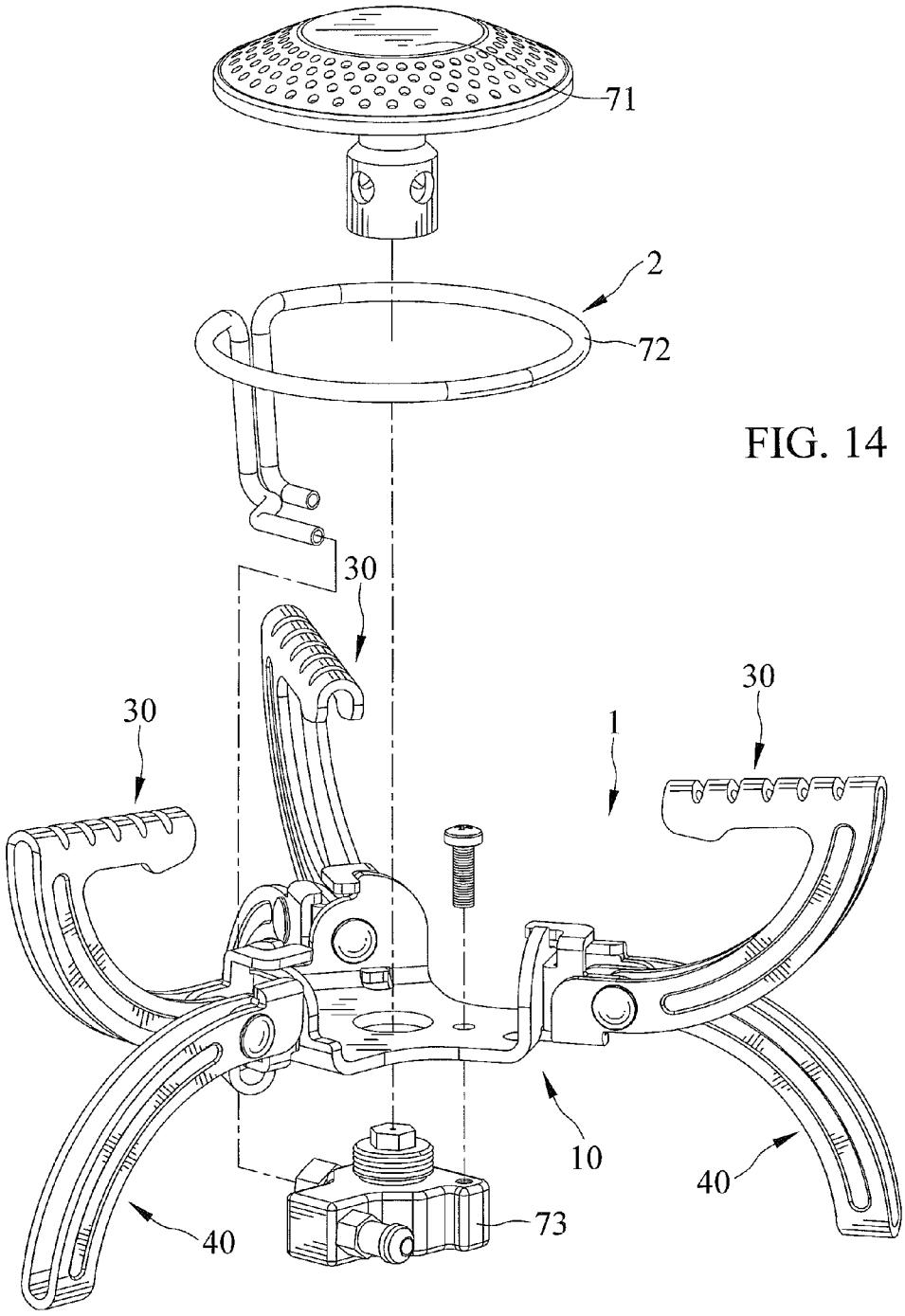
FIG. 14 shows an exploded, perspective view of the supporting assembly for the portable stove, and illustrates the portable stove mounted to the base of the supporting assembly.
Figure 15:
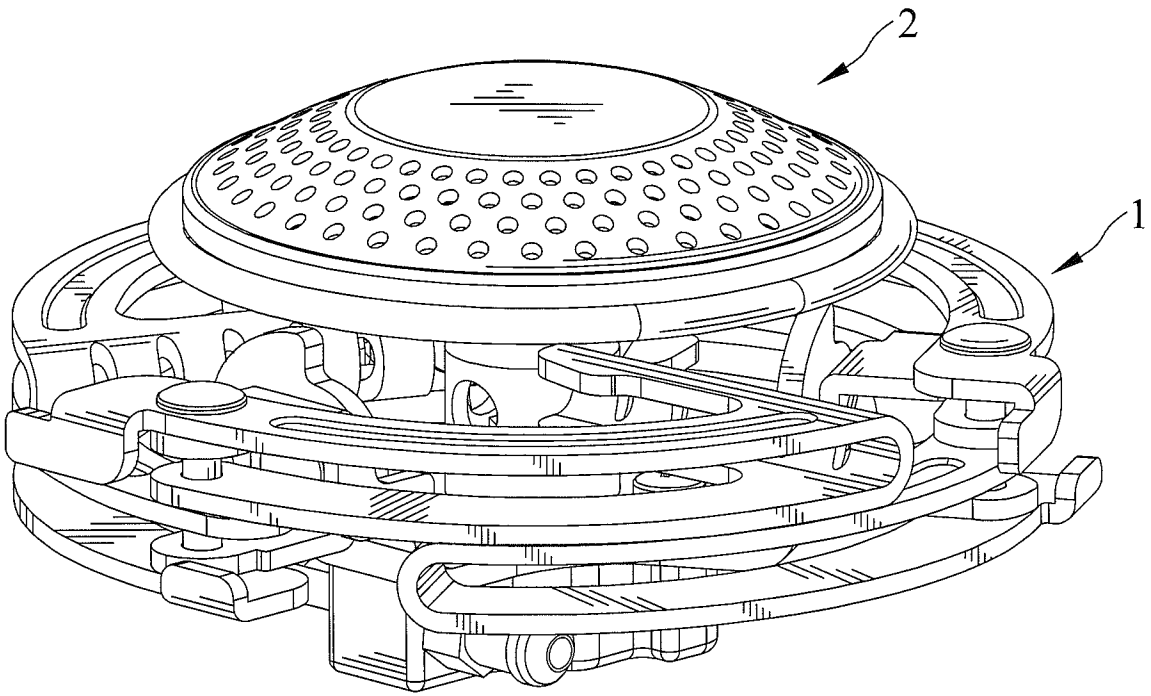
FIG. 15 shows a perspective view of the supporting assembly for the portable stove, and illustrates the portable stove mounted to the base of the supporting assembly, with the supporting assembly being in the folded storage position.
Figure 16:
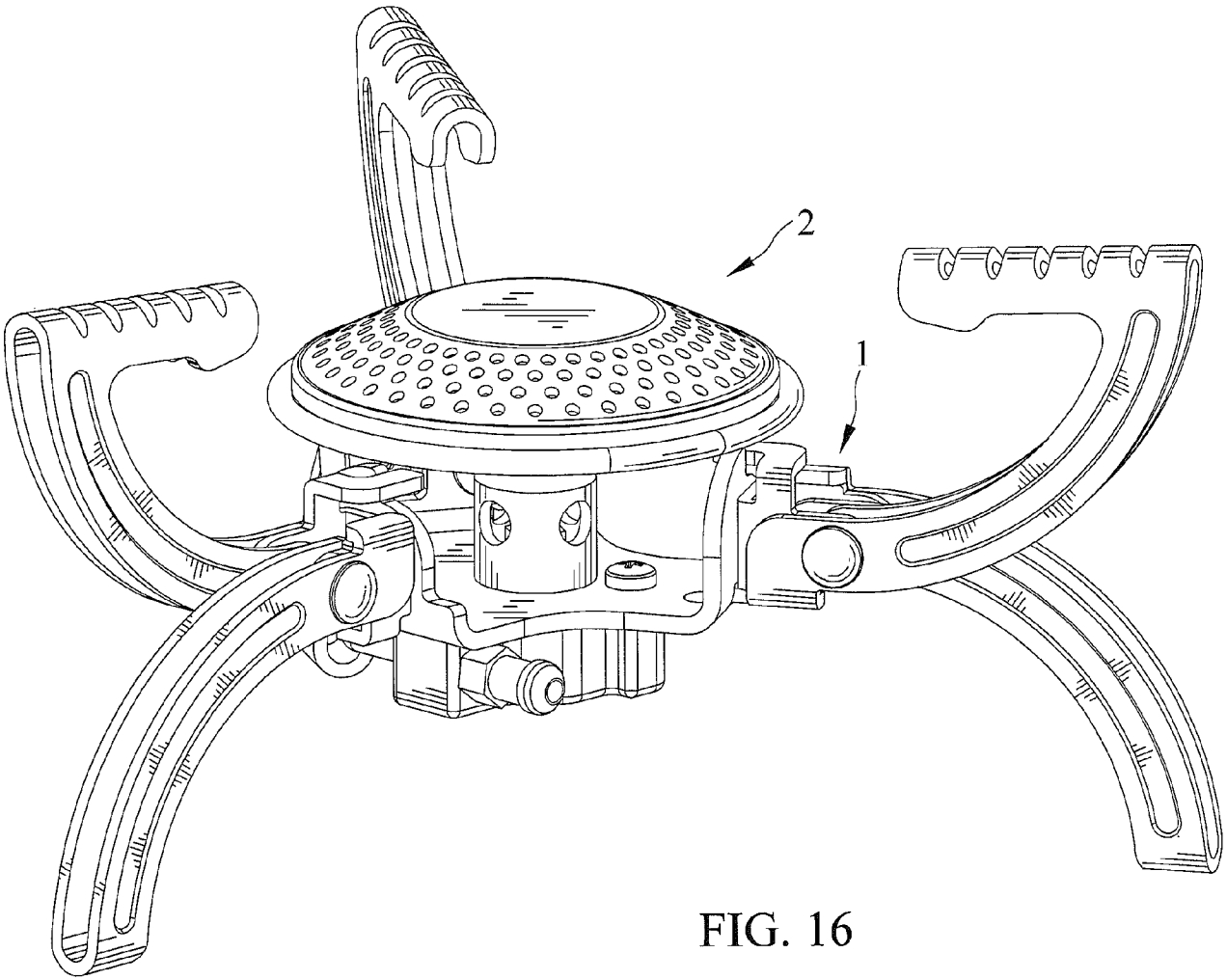
FIG. 16 shows a perspective view of the supporting assembly for the portable stove of FIG. 15, and illustrates the supporting assembly being in the operative position.

FIGS. 14 through 16 show the portable stove 2 mounted on the base 10 of the supporting assembly 1 and includes a burner core 71, a frame 72, and a seat 73. The burner core 71 and the seat 73 are assembled at two opposite ends of the base 10. The frame 72 is disposed between the burner core 71 and the seat 73.

The supporting assembly for the portable stove includes the following advantages:

1. The supporting assembly 1 for the portable stove 2 is reversibly transformable between a folded storage position and an operative position. When the supporting assembly 1 is disposed in the folded storage position, the plurality of second supporting members 40 and the base 10 are substantially horizontally aligned, and the plurality of second supporting members 40 and the plurality of first supporting members 30 are parallel to each other, so that the supporting assembly 1 is formed in a disc-shape for easy storage or transportation.

2. The supporting assembly 1 for the portable stove 2 is transformable from the folded storage position to the operative position without any tools for assembling, and avoids the components thereof lost.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

What is claimed is:

1. A supporting assembly for a portable stove comprising:

a base installed the portable stove and including a plurality of extending portions extending from a central portion thereof, with each of the plurality of extending portions formed a connecting portion;

a plurality of connecting members each pivotally connected with each of the plurality of connecting portions of the base, with each of the plurality of connecting members including a connecting wall, first and second jaw portions respectively extending from two opposite distal ends of the connecting wall;

a plurality of first supporting members each pivotally connected with each of the plurality of first jaw portions of the plurality of connecting members, with each of the plurality of first supporting members including a first supporting portion extending from a distal end thereof toward the base; and a plurality of second supporting members each pivotally connected with each of the plurality of second jaw portions of the plurality of connecting members, with each of the plurality of second supporting members including a second supporting portion extending from a distal end thereof;

wherein the supporting assembly for the portable stove is transformable from a folded storage position to an operative position, with the first supporting portions of the plurality of first supporting members able to support a cooking vessel thereon, with the second supporting portions of the plurality of second supporting members supporting the supporting assembly for the portable stove on a supportive substrate.

2. The supporting assembly for the portable stove as claimed in claim 1, wherein each of the plurality of connecting portions includes a first through hole extending along a first axis, with each of the plurality of connecting members including a second through hole extending at the connecting wall along the first axis, with a plurality of first fasteners respectively passing through the second through holes of the plurality of connecting members and the first through holes of the plurality of connecting portions to cause each of the plurality of connecting members pivotally connected with each of the plurality of connecting portions of the base along the first axis.

3. The supporting assembly for the portable stove as claimed in claim 2, wherein each of the plurality of first supporting members includes first and second body portions connected with each other, and the first supporting portion extending axially inward from distal ends of the first and second body portions toward the base, wherein each of the plurality of second supporting members includes third and fourth body portions connected with each other, and the second supporting portion formed between distal ends of the third and fourth body portions.

4. The supporting assembly for the portable stove as claimed in claim 3, wherein the first and second jaw portions of each of the plurality of connecting members are respectively axially formed first and second apertures extending along a second axis perpendicular to the first axis;

wherein the first and second body portions of each of the plurality of first supporting members are respectively axially formed third and fourth apertures extending along the second axis at terminal ends thereof opposite to the first supporting portion;

wherein the third and fourth body portions of each of the plurality of second supporting member are respectively axially formed fifth and sixth apertures extending along the second axis at terminal ends thereof opposite to the second supporting portion;

wherein a plurality of second fasteners respectively pass through the third apertures of the first supporting members, the first apertures of the connecting members, the fourth apertures of the first supporting members, the fifth apertures of the second supporting members, the second apertures of the connecting members, and the sixth apertures of the second supporting members to cause each of the plurality of first and second supporting members both pivotally connected with each of the plurality of connecting member along the second axis.

5. The supporting assembly for the portable stove as claimed in claim 4, wherein each of the plurality of connecting members are pivotally connected with each of the plurality of connecting portions along the first axis by riveting;

wherein each of the plurality of first and second supporting members are both pivotally connected with each of the plurality of connecting member along the second axis by riveting.

6. The supporting assembly for the portable stove as claimed in claim 2, wherein each of the plurality of connecting portions includes an recess formed at a side edge thereof, with the recess has first and second positioning ends, with the first positioning end disposed adjacent to the extending portion, with the second positioning end disposed opposite to the first positioning end, with each of the plurality of connecting members including a first resisting portion extending from a side edge of the first jaw portion in a direction parallel to the first axis;

wherein when the supporting assembly is disposed in the folded storage position, each of the first resisting portions of the plurality of connecting members is abutted against the first positioning end of each of the recesses, wherein when the supporting assembly is disposed in the operative position, each of the first resisting portions of the plurality of connecting members is abutted against the second positioning end of each of the recesses.

7. The supporting assembly for the portable stove as claimed in claim 1, wherein a bottom face of each of the plurality of first supporting members is formed a groove, with a top face of each of the plurality of second supporting member formed a bump being engagable with the groove of each of the plurality of first supporting members;

wherein when the supporting assembly is disposed in the folded storage position, with each of the bumps engaging into each of the grooves to provide a positioning function between the plurality of first and second supporting members;

wherein when the supporting assembly is disposed in the operative position, with each of the bumps disengaging from each of the grooves.

8. The supporting assembly for the portable stove as claimed in claim 1, wherein each of the plurality of first supporting members has an arc shape, wherein each of the plurality of second supporting members has an arc shape.

9. The supporting assembly for the portable stove as claimed in claim 1, wherein the base is formed a Y-shaped cross section and includes three extending portions extending outward from the central portion thereof and formed between three angles of the same angle.

10. The supporting assembly for the portable stove as claimed in claim 9, wherein when the supporting assembly is disposed in the folded storage position, each of the first supporting portions of the plurality of first supporting members is engaged with a space formed between two of the three connecting portions.

* * * * *